US008109316B2

(12) United States Patent
Wang

(10) Patent No.: US 8,109,316 B2
(45) Date of Patent: Feb. 7, 2012

(54) SLAT MEMBER AND FIREPROOF, HEAT-INSULATING SLAT AND ROLLING DOOR

(76) Inventor: Shih-Hsien Wang, Taipei County (TW)

( * ) Notice: Subject to any disclaimer, the term of this patent is extended or adjusted under 35 U.S.C. 154(b) by 68 days.

(21) Appl. No.: 12/805,544

(22) Filed: Aug. 5, 2010

(65) Prior Publication Data

US 2011/0108210 A1 May 12, 2011

(51) Int. Cl.
*E06B 9/165* (2006.01)

(52) U.S. Cl. ..... 160/232; 160/236

(58) Field of Classification Search ..... 160/232, 160/235, 236, 133, 199, 206; 49/92.1; 52/578, 52/588.1

See application file for complete search history.

(56) References Cited

U.S. PATENT DOCUMENTS

| | | | | | |
|---|---|---|---|---|---|
| 3,479,784 | A | * | 11/1969 | Massagli | 52/588.1 |
| 4,042,005 | A | * | 8/1977 | Hammerstein | 160/220 |
| 4,382,460 | A | * | 5/1983 | Ben-Tal | 160/236 |
| 4,470,444 | A | * | 9/1984 | Riexinger et al. | 160/235 |
| 4,628,982 | A | * | 12/1986 | Labelle | 160/235 |
| 4,723,588 | A | * | 2/1988 | Ruppel | 160/236 |
| 4,979,553 | A | | 12/1990 | Lowry, III et al. | |
| 5,419,386 | A | * | 5/1995 | Magro et al. | 160/232 |
| 5,515,902 | A | * | 5/1996 | Hoffman | 160/235 |
| 7,743,815 | B2 | * | 6/2010 | Clauss | 160/133 |
| 2003/0024659 | A1 | * | 2/2003 | Begni | 160/235 |

FOREIGN PATENT DOCUMENTS

| | | | |
|---|---|---|---|
| EP | 1076149 | A2 | 2/2001 |
| EP | 1389664 | A1 | 2/2004 |
| WO | 99/64710 | A1 | 12/1999 |

* cited by examiner

*Primary Examiner* — David Purol
(74) *Attorney, Agent, or Firm* — Bacon & Thomas, PLLC

(57) ABSTRACT

A fireproof, heat-insulating slat consists of a pair of slat members having the same structure and disposed in the opposite directions. An enclosed space is formed between the pair of slat members. A first upper shoulder and a first lower shoulder are formed on the top end of the slat from the left to the right, and a second lower shoulder and a second upper shoulder are formed on the bottom end of the slat from the left to the right. An upper hinge and a lower hinge part are formed on the first lower shoulder and the second lower shoulder, respectively, and the upper hinge part and the lower hinge part are bent toward the first upper shoulder and the second upper shoulder, respectively. The enclosed space is filled with a fireproof, heat-insulating material.

9 Claims, 4 Drawing Sheets

SLAT MEMBER AND FIREPROOF, HEAT-INSULATING SLAT AND ROLLING DOOR

BACKGROUND OF THE INVENTION

1. Field of the Invention

The present invention relates to a slat and a rolling door, and particularly to a fireproof, heat-insulating slat and a fireproof, heat-insulating rolling door.

2. Description of the Related Art

A general fireproof rolling door is used for staff access control in peacetime. However, when a fire accident occurs, it works to block smokes, flames and heat. According to the heat resistant standard, instituted by Bureau of Standards, Metrology and Inspection of Taiwan for fireproof rolling doors set in buildings, when the temperature of the fire side of the fireproof rolling door reaches 1,000° C. for one or more hours, the temperature of the other side thereof shall be below 170° C.

In order to improve the fireproofing of the traditional fireproof rolling door to conform to the national heat resistant standard of Taiwan, for example, as shown in FIG. 8, the inventor of the present invention disclosed a "fireproof, heat-insulating slat and rolling door thereof" in Taiwanese Patent Application No. 98114934, wherein it provides a slat member (10), having a projecting hinge (12) on the top end thereof and a recessed hinge part (14) on the bottom end thereof. A hollow air chamber (16) is formed within the slat member. Viewed in the cross-section of the slat member (10), an upper shoulder (15*a*) is formed on one side of the top end, and a lower shoulder (15*b*) is formed on the other side of the top end; an upper base (17*a*) is formed on one side of the bottom end, and a lower base (17*b*) which is relatively lower is formed on the other side of the bottom end. A layer of fireproof, heat-insulating material (11) is coated on the front surface and rear surface of the slat member, and the fireproof, heat-insulating material (11) is covered with a metal plate (13). Smoke-isolating gaskets (18) are provided on the upper and lower shoulders (15*a*, 15*b*) of the slat member (10). Thus, a rolling door curtain consisting of a plurality of fireproof, heat-insulating slats forms a firewall with the fireproof, heat-insulating material for heat isolation.

Although the above prior art can basically isolate heat effectively, such a slat has a complex structure and is hard to manufacture easily, causing the manufacture cost being relatively expensive.

SUMMARY OF THE INVENTION

A main object of the present invention is to provide a fireproof, heat-insulating slat and a rolling door with the same for insulating heat effectively.

To achieve the above and other objects, the fireproof, heat-insulating slat according the present invention consists of a pair of slat members having the same structure and disposed upside down, wherein an enclosed space is formed between the pair of slat members, and the enclosed space is filled with fireproof, heat-insulating material. The slat comprises: a first upper shoulder and a first lower shoulder, formed on the top end; a first recess, formed between the first upper shoulder and the first lower shoulder; a second lower shoulder and a second upper shoulder, formed on the bottom end; a second recess, formed between the second lower shoulder and the second upper shoulder; an upper hinge part, extending upward from the first lower shoulder and bent toward the first upper shoulder; a lower hinge part, extending downward from the second lower shoulder and bent toward the second upper shoulder. Thus, a fireproof, heat-insulating rolling door consisting of a plurality of slats is formed with the firewall of the curtain of the rolling door efficiently insulating heat.

According to the present invention, a plurality of slats are used to form a door curtain having a desired height and length by engaging the upper hinge part of a slat with the lower hinge part of another slat, and thus it is much easier to apply to any size of a general rolling door. Also, two slat members is assembled into a slat in a simple manner, and the space between the two slat members is filled with fireproof, heat-insulating material easily, and cut down cost of production.

DESCRIPTION OF THE PREFERRED EMBODIMENTS

Figure 1:
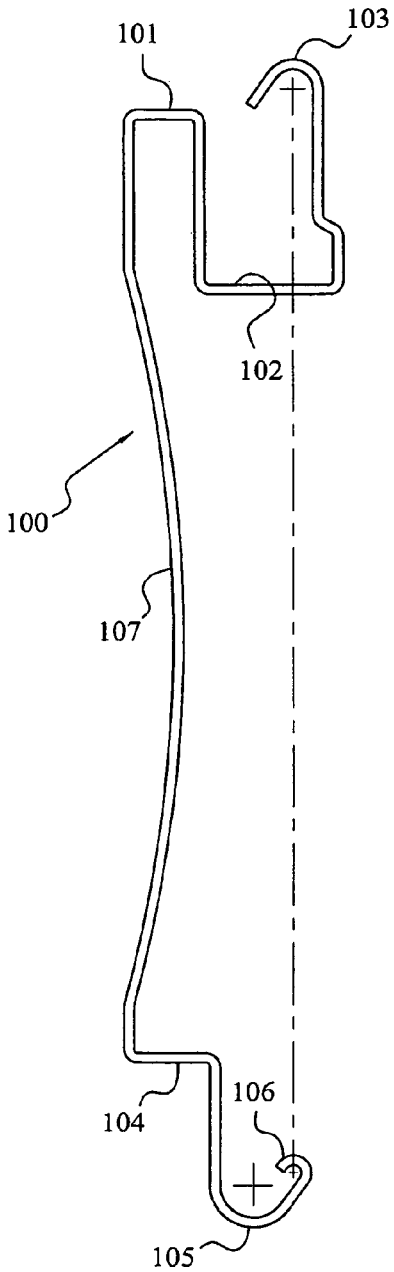
FIG. 1 is a side view of a slat member of the present invention.

First, please referring to FIG. 1, a slat member 100 according to the present invention is formed by bending the top end and the bottom end of an elongated sheet material. From the left to the right, the top end comprises: an upper shoulder 101 formed on the top end, a recess 102 located on one side of the upper shoulder 101 and lower than the upper shoulder 101; and an upper hinge part 103, extending upward from the recess 102 and bent toward the upper shoulder 101 to be a hook shape. The bottom end of the slat member 100, from the left to the right, comprises: a lower shoulder 104, formed on the bottom end; and a lower hinge part 105, extending downward from the lower shoulder 104 and bent toward a direction away from the lower shoulder 104 to be a hook shape.

Figure 2:
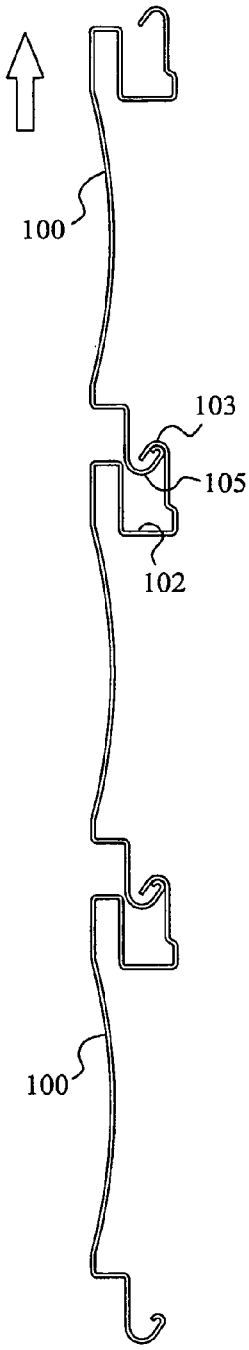
FIG. 2 shows a door curtain consisting of slat members of FIG. 1, wherein the door curtain is being rolled up.
Figure 3:
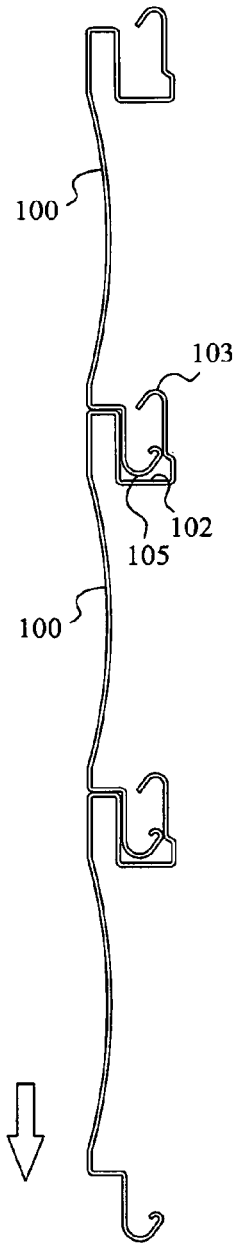
FIG. 3 shows a door curtain consisting of slat members of FIG. 1, wherein the door curtain is already rolled down.

According to the present invention, the radius of curvature of the hook of the lower hinge part 105 is larger than that of the upper hinge part 103, and a semirounded hook hinge part 106 bent inward is formed on the end of the lower hinge part 105. The side face of the slat member 100 between the upper shoulder 101 and the lower shoulder 104 is recessed as an inward recessed face 107. A plurality of slat members forms a door curtain having a desired height and length by connecting the upper hinge part and the lower hinge part of the adjacent slat members, and this can be applicable to a general rolling door (as shown in FIG. 2 and FIG. 3). The inward recessed face 107 between the upper shoulder 101 and the lower shoulder 104 can effectively reduce the radius of a door curtain roll, which is formed by rolling the door curtain.

Figure 4:
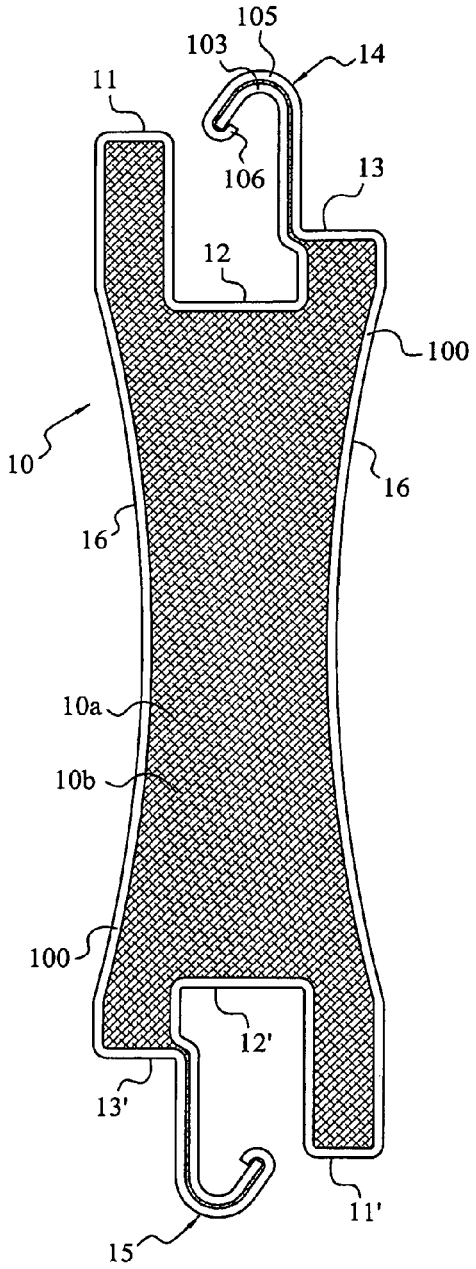
FIG. 4 is a schematic view of an embodiment of a fireproof, heat-insulating slat according to the present invention.

FIG. 4 shows an embodiment of a fireproof, heat-insulating slat 10 according to prevent invention, which consists of the slat members 100. According to the prevent invention, the fireproof, heat-insulating slat 10 consists of a pair of slat members 100 having the same structure and disposed upside down. That is, in a pair of slat members 100, the upper hinge part 103 of one slat member is connected to the lower hinge part 105 of the other slat member, and the connection of the slat members is maintained by the hook parts 106 on the ends of the lower hinge part 105 of the two slat members. Between the pair of slat members, an enclosed space 10*a* is formed, and the enclosed space 10*a* is filled with a fireproof, heat-insulating material 10*b*. The slat 10 from the left to the right, comprises: a first upper shoulder 11 and a first lower shoulder 13, formed on the top end of the slat 10; and a first recess 12, formed between the first upper shoulder 11 and the first lower shoulder 13. The slat 10 from the left to the right, comprises: a second lower shoulder 13' and a second upper shoulder 11', formed on the bottom end of the slat 10; and a second recess 12', formed between the second lower shoulder 13' and the second upper shoulder 11'. The second lower shoulder 13' and the second upper shoulder 11' corresponds to the first upper shoulder 11 and the first lower shoulder 13, respectively. An upper hinge part 14 extends upward from the first lower shoulder 13 and a hook formed on the top end of the slat 10 and is bent toward the first upper shoulder 11. Also, a lower hinge part 15 extends downward from the second lower shoulder 13' and another hook is formed on the bottom end of the slat 10 and is bent toward the second upper shoulder 11'. According to the present invention, the position of the curvature center of the hook of the upper hinge part 14 is higher than the first upper shoulder 11 formed on the top end of the slat 10; the position of the curvature center of the hook of the lower hinge 15 is lower than the second upper shoulder 11' formed on the bottom end of the slat 10. The two main surfaces of the slat 10 are recessed as inward recess-curved faces 16 with a radius of curvature, respectively. The two main surfaces are located between the first upper shoulder 11 and the second lower shoulder 13' and between the second upper shoulder 11' and the first lower shoulder 13, respectively.

Figure 5:
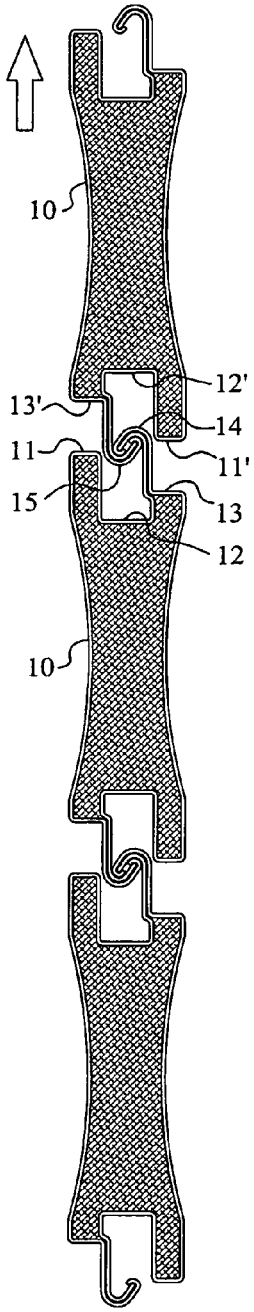
FIG. 5 shows a door curtain consisting of the fireproof, heat-insulating slats of FIG. 4, wherein the door curtain is being rolled up.
Figure 6:
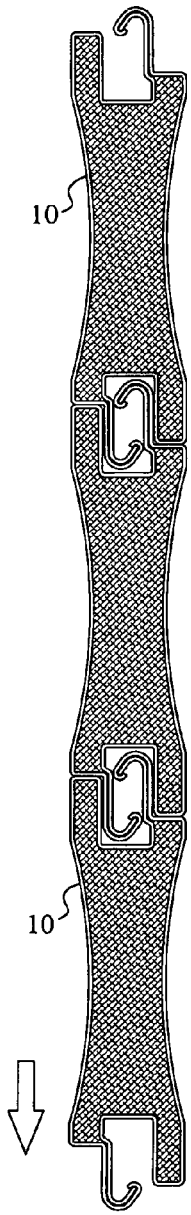
FIG. 6 shows a door curtain consisting of the fireproof, heat-insulating slats of FIG. 4, wherein the door curtain is already rolled down.
Figure 7:
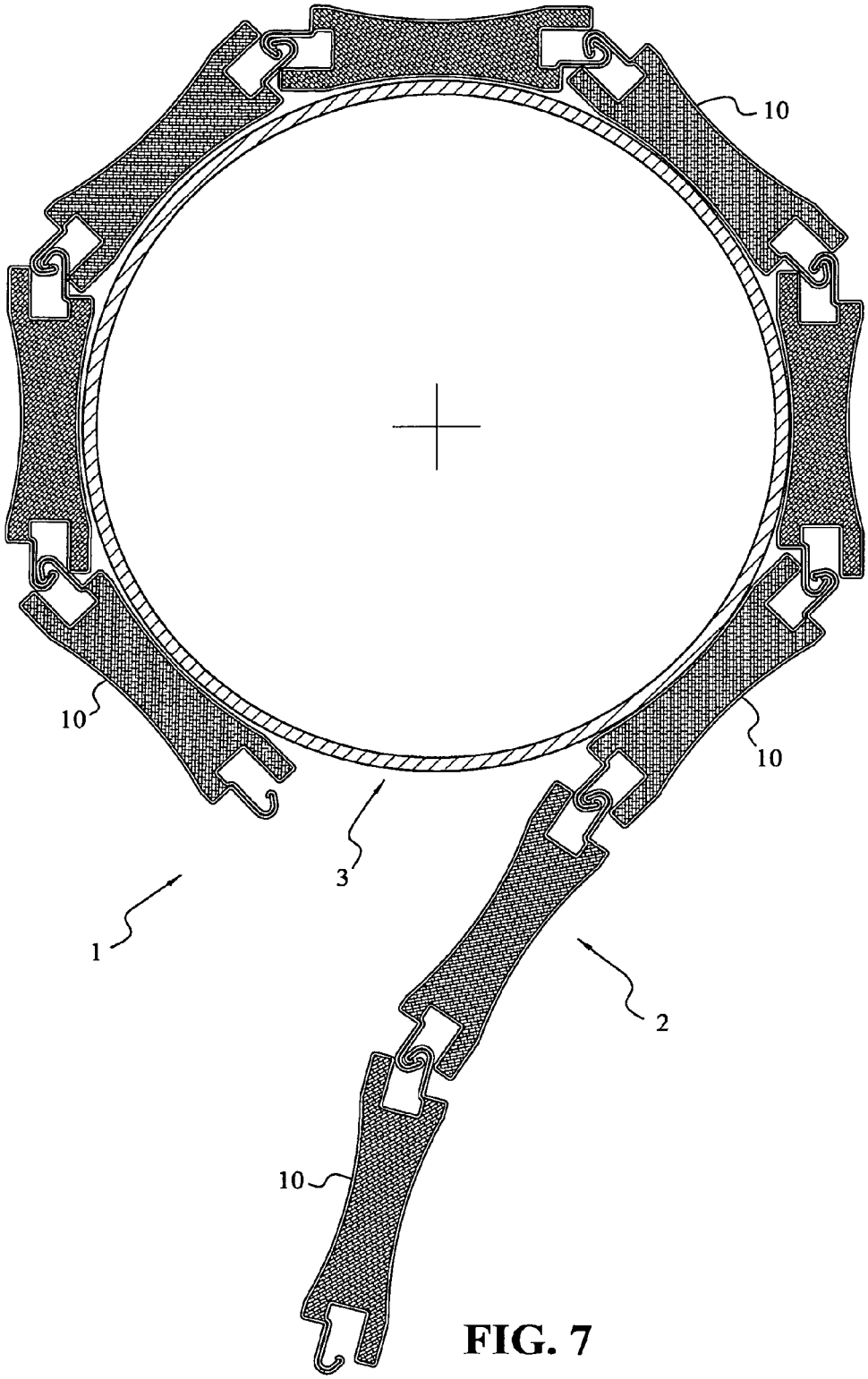
FIG. 7 is a schematic view of a fireproof, heat-insulating rolling door according to the prevent invention.
Figure 8:
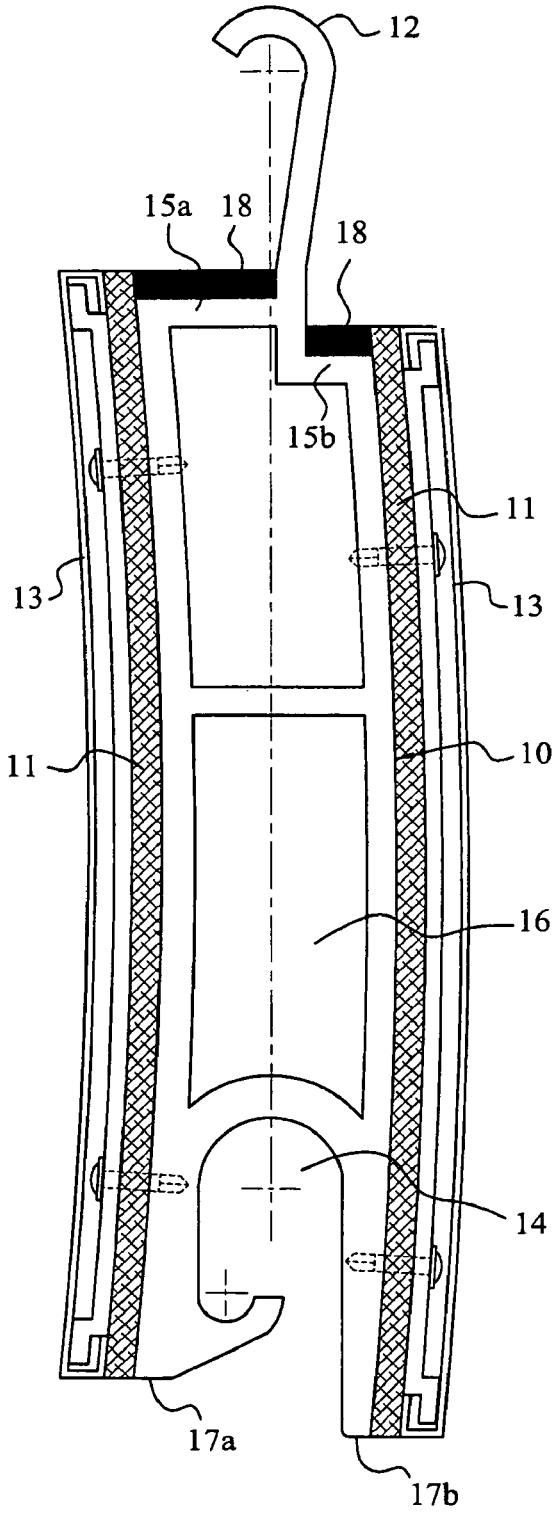
( PRIOR ART ) FIG. 8
FIG. 8 shows a traditional fireproof, heat-insulating slat, which is described in Taiwanese Patent Application No. 98114934 filed by the present inventor previously.

As shown in FIGS. 5 to 7, two adjacent slat 10 are connected to each other by the upper hinge part 14 of the lower one of the two adjacent slats 10 and the lower hinge part 15 of the upper one of the two adjacent slats 10, so that a door curtain 2 having a desired height or length can be formed, and such a door curtain can be applicable to a fireproof, heat-insulating rolling door 1 for a building. Winding or unwinding the door curtain 2 via a traditional winding shaft 3, the door curtain 2 can be rolled up or down along a track. FIG. 5 shows that the door curtain 2 is being rolled up, i.e., the door curtain 2 is to be opened. According to the present invention, a first gap is formed between the first recess 12 and the upper hinge part 14 on the top end of the slat 10, and the lower hinge part 15 of another upper slat 10 can move up and down in the first gap; a second gap is formed between the second recess 12' and the lower hinge part 15 on the bottom end of the slat 10, and the upper hinge part 14 of another lower slat 10 can move up and down in the second gap, so that two adjacent slats 10 can move in a direction toward each other or away from each other. This arrangement is beneficial for rolling the slats. Furthermore, the two main surfaces of each slat 10 are recessed as inward recessed curved faces 16, so that the radius of a door curtain roll, which is formed by winding the slats, can be reduced effectively.

FIG. 6 shows that the door curtain 2 is already rolled down, i.e., the rolling door 1 is in a closed state. When the winding shaft 3 unwinds the door curtain 2 to reach a down stop point, two adjacent slats 10 are abutted against each other due to gravity. On one main surface side, the first upper shoulder 11 of the lower slat 10 is abutted against the second lower shoulder 13' of the upper slat 10, while on the other main surface side, the first lower shoulder 13 of the lower slat 10 is abutted against the second upper shoulder 11' of the upper slat 10. The door curtain 2 from the top to the bottom, forms a firewall with the fireproof, heat-insulating material 10*b* for complete heat insulation. The joint of two adjacent slats 10 can be insulated by the fireproof, heat-insulating material 10*b*. The fireproof, heat-insulating rolling door according to the prevent invention, not only block smokes and flames, but also insulate heat.

While this invention has been described with reference to the embodiments, it should be understood that various changes and modifications could be made within the spirit and scope of the inventive concepts described. Accordingly, it is intended that the invention shall not be limited to the disclosed embodiments but have the full scope permitted by the language of the following claims.

What is claimed is:

1. A slat member (100), with a top end configuration and a bottom end configuration formed by bending a top portion and bottom portion of an elongated sheet respectively, the slat member (100) comprising:

an upper shoulder (101) and a recess 102, formed on the top end of the slat member (100), the recess (102) being formed on one side of the upper shoulder (101) and lower than the upper shoulder (101);

an upper hinge part (103), extending upward from the recess (102) a first predetermined distance and bent toward the upper shoulder (101) to shape a first hook;

a lower shoulder (104), formed on the bottom end of the slat member (100) corresponding to the upper shoulder (101); and a lower hinge part (105), extending downward from the lower shoulder (104) a second predetermined distance shorter than the first predetermined distance and bent toward a direction away from the lower shoulder 104 to shape a second hook.

2. The slat member (100) as claimed in claim 1, wherein a radius of a curvature of the second hook of the lower hinge part (105) is larger than that of the first hook of the upper hinge part (103).

3. The slat member (100) as claimed in claim 2, wherein a semirounded part (106) is further formed on an end of the second hook of the lower hinge part (105).

4. The slat member (100) as claimed in claim 3, wherein a side surface between the upper shoulder (101) and the lower shoulder (104) is curved inward thereof.

5. A fireproof, heat-insulating slat (10), comprising a pair of slat members (100) as claimed in claim 1, the slat members (100) disposed upside down thereof and combined with each other, an enclosed space (10*a*) being formed between the slat members (100), and the space (10*a*) being filled with fireproof, heat-insulating material (10*b*), the slat (10) comprises:

a first upper shoulder (11) and a first lower shoulder (13), formed on a top end of the slat (10);

a first recess (12), formed between the first upper shoulder (11) and the first lower shoulder (13);

a second lower shoulder (13') and a second upper shoulder (11'), formed on a bottom end of the slat (10), the second lower shoulder (13') and the second upper shoulder (11') corresponding to the first upper shoulder (11) and the first lower shoulder (13), respectively;

a second recess (12'), formed between the second lower shoulder (13') and the second upper shoulder (11');

an upper hinge part 14, extending upward from the first lower shoulder (13) formed on the top end of the slat 10 and bent toward the first upper shoulder (11) to shape a first hook; and a lower hinge part (15), extending downward from the second lower shoulder (13') formed on the bottom end of the slat (10) and bent toward the second upper shoulder (11') to shape a second hook.

6. The slat (10) as claimed in claim 5, wherein a position of a curvature center of each the first hook of the upper hinge part (14) and the second hook of the lower hinge part (15) is above the first upper shoulder (11) and the second upper shoulder (11') by a predetermined distance.

7. The slat (10) as claimed in claim 5, wherein two main side surfaces of the slat (10) each located between the first upper shoulder (11) and the second lower shoulder (13') and between the second upper shoulder (11') and the first lower shoulder (13), respectively, are curved as concavoconcave faces.

8. The slat (10) as claimed in claim 6, wherein a first space is defined between the first recess (12) and the upper hinge part (14), for a lower hinge part of an adjacent upper slat being moveable in the first space; a second space is defined between the second recess (12') and the lower hinge part (15), for an upper hinge part of an adjacent lower slat being moveable in the second space.

9. A fireproof, heat-insulating rolling door (1), comprising a winding shaft (3) for winding or unwinding a door curtain (2) up or down along a track, wherein the door curtain (2) consists of a plurality of slats (10) as claimed in claim 5; and two adjacent slats (10) are engaged to each other through the first hook of the upper hinge part (14) of one of the two adjacent slats and the second hook of the lower hinge part (15) of the other of the two adjacent slats.

* * * * *